US009314141B2

(12) United States Patent
Lee et al.

(10) Patent No.: US 9,314,141 B2
(45) Date of Patent: Apr. 19, 2016

(54) ROBOT CLEANER

(71) Applicant: SAMSUNG ELECTRONICS CO., LTD., Suwon-si, Gyeonggi-do (KR)

(72) Inventors: Dong Hun Lee, Ansan-si (KR); Shin Kim, Hwaseong-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 524 days.

(21) Appl. No.: 13/722,174

(22) Filed: Dec. 20, 2012

(65) Prior Publication Data

US 2013/0160226 A1 Jun. 27, 2013

(30) Foreign Application Priority Data

Dec. 22, 2011 (KR) ..... 10-2011-0140035

(51) Int. Cl.
*A47L 11/24* (2006.01)
*A47L 9/04* (2006.01)

(52) U.S. Cl.
CPC ..... *A47L 9/0488* (2013.01); *A47L 11/24* (2013.01); *A47L 2201/00* (2013.01)

(58) Field of Classification Search
CPC .... A46B 5/002; A46B 5/0033; A46B 5/0041; A46B 5/0058; A46B 5/0075; A46B 5/0083; A46B 7/023; A46B 7/026; A47L 9/0488; A47L 9/0466
USPC ..... 15/21.1, 41.1, 42, 179, 180, 185, 319, 15/339, 340.4, 365, 373; 403/112, 113
See application file for complete search history.

(56) References Cited

U.S. PATENT DOCUMENTS

| | | | | |
|---|---|---|---|---|
| 6,883,201 | B2 | 4/2005 | Jones et al. | |
| 2007/0234492 | A1 * | 10/2007 | Svendsen et al. | 15/21.1 |
| 2007/0234493 | A1 * | 10/2007 | Hilscher et al. | 15/22.2 |
| 2008/0284363 | A1 * | 11/2008 | Lucas et al. | 318/441 |

FOREIGN PATENT DOCUMENTS

| | | | | |
|---|---|---|---|---|
| CN | 1726860 | | 2/2006 | |
| CN | 101884512 | | 11/2010 | |
| FR | 2464674 | * | 2/1979 | A46B 15/00 |
| JP | 2005-6857 | | 1/2005 | |
| JP | 4097264 | | 6/2008 | |
| KR | 10-2009-0033608 | | 4/2009 | |

OTHER PUBLICATIONS

Chinese Office Action dated Feb. 14, 2016 in corresponding Chinese Patent Application No. 201210566420.7.

* cited by examiner

*Primary Examiner* — Joseph J Hail
*Assistant Examiner* — J. Stephen Taylor
(74) *Attorney, Agent, or Firm* — Staas & Halsey LLP

(57) ABSTRACT

A robot cleaner capable of improving the external esthetic quality thereof while enhancing the cleaning performance, the robot cleaner including a body configured to remove dust while navigating on a floor and to form an external appearance of the robot cleaner, and a side brush assembly installed at the body to clean corners of the floor, wherein the side brush assembly includes a motor configured to supply a power while being installed at the body, a rotation shaft coupled to the motor, and a plurality of side brushes rotatably coupled to the rotation shaft, and wherein the plurality of side brushes have respective intervals changed with respect to one another such that the plurality of side brushes are prevented from being exposed to outside the body.

16 Claims, 11 Drawing Sheets

ROBOT CLEANER

CROSS-REFERENCE TO RELATED APPLICATIONS

This application claims the benefit of Korean Patent Application No. 2011-0140035, filed on Dec. 22, 2011 in the Korean Intellectual Property Office, the disclosure of which is incorporated herein by reference.

BACKGROUND

1. Field

One or more embodiments relate to a robot cleaner provided with a side brush serving to collect dust on an area adjacent to a wall surface and on a floor toward an inner side thereof.

2. Description of the Related Art

In general, a robot cleaner is an apparatus designed to automatically clean a cleaning area, which is to be cleaned, by autonomously navigating the cleaning area without a manipulation of a user to draw foreign substance such as dust from the surface of a floor.

The robot cleaner performs a cleaning on the cleaning area by detecting a distance to an obstacle, including furniture and office supplies installed within the cleaning area and walls, through various types of sensors, and navigating while preventing a collision with the obstacles.

Cleaning a designated area refers to repeatedly performing a cleaning task of a robot cleaner while navigating in a predetermined navigation pattern.

The robot cleaner as such performs a cleaning by autonomously determining a cleaning place based on signals from a plurality of sensors, and is provided with a side brush that serves to collect dust in an area adjacent to walls or on the floor toward an inner side thereof so as to improve the cleaning performance.

The side brush of the robot cleaner is mounted at each side of a cleaner body, and while rotating on a rotation shaft that is formed in a vertical direction, scrapes and gathers dust on the floor toward the inner side of the robot cleaner.

However, the side brush is installed in a form protruding outward the body, degrading the external esthetic quality.

In addition, in a case that the side brush is installed at an inner side of the body in order to improve the external esthetic quality, a zone to which the side brush fails to reach is present, thereby having a difficulty in cleaning corners of the cleaning area.

SUMMARY

One or more embodiments relate to a robot cleaner capable of improving the external esthetic quality.

One or more embodiments relate to a robot cleaner capable of enhancing the cleaning performance.

In accordance with one or more embodiments, a robot cleaner may include a body and a side brush assembly. The body may be configured to remove dust while navigating on a floor and to form an external appearance of the robot cleaner. The side brush assembly may be installed at the body to clean corners of the floor. The side brush assembly may include a motor, a rotation shaft and a plurality of side brushes. The motor may be configured to supply a power while being installed at the body. The rotation shaft may be coupled to the motor. The plurality of side brushes may be rotatably coupled to the rotation shaft. The plurality of side brushes may have respective intervals changed with respect to one another so as to be prevented from being exposed to outside the body.

The plurality of side brushes may have the respective intervals changed according to a rotation direction of the plurality of side brushes.

The plurality of side brushes may have the respective intervals increased according to one side direction of rotation of the plurality of side brushes.

The plurality of side brushes may have the respective intervals decreased according to the other side direction of rotation of the plurality of side brushes.

The side brush assembly may include a first side brush and at least one side brush. The first side brush may be fixed to the rotation shaft so as to enable a rotation. The at least one side brush may be rotatably coupled to the rotation shaft so as to operate according to rotation of the first side brush.

The side brush assembly may include a variable member installed between the side brushes and may be configured to allow the intervals of the side brushes to be changed.

The variable member may include a first variable part and a plurality of variable parts. The first variable part may be provided to link the first side brush with the side brush. The plurality of variable parts may be disposed between side brushes so as to operate according to rotation of the first variable part.

The first variable part may include a first support part and a second support part. The first support part may be configured to rotate according to a rotation direction of the first side brush. The second support part may protrude at an other end portion of the first variable part in an opposite direction to the first support part.

The variable part may include a first variable part and a second variable part. The first variable part may have a first support part that may protrude at an end portion of the first variable part and may make contact with the first side brush when the first side brush rotates in an operation mode. The first variable part may have a second support part that may protrude at an other end portion of the first variable part in an opposite direction to the first support part. The second variable part may have a third support part that may protrude at an end portion of the second variable part and may contact the second support part of the first variable part when the first variable part rotates by the rotation of the first side brush.

The plurality of side members may include a plurality of side brush arms and a brush. The plurality of side brush arms may be rotatably coupled to the rotation shaft. The brush may be provided at each of the plurality of brush arms to brush the floor.

The plurality of side brushes may further include a linking protrusion configured to allow the side brushes to be linked to one another according to rotation of the side brushes in the other side direction.

The linking protrusion may be formed on each of the plurality of side brush arms.

In accordance with one or more embodiments, a robot cleaner may include a body and a side brush assembly. The body may be configured to remove dust while navigating on a floor and to form an external appearance of the robot cleaner. The side brush assembly may be installed at the body to clean corners of the floor. The side brush assembly may include a motor, a rotation shaft, a plurality of side brushes and a variable member. The motor may be configured to supply a power while being installed at the body. The rotation shaft may be coupled to the motor. The plurality of side brushes may be rotatably coupled to the rotation shaft. The variable member may be configured to allow respective intervals of the side brushes to be changed with respect to one another according to a rotation direction of the plurality of side brushes, such that the plurality of side brushes are prevented from being exposed to an outside the body.

The plurality of side brushes may have the respective intervals increased according to one side direction of rotation of the plurality of side brushes, and the plurality of side brushes may have the respective intervals decreased according to the other side direction of rotation of the plurality of side brushes.

The plurality of side brushes may further include a linking protrusion configured to allow the side brushes to be linked to one another according to rotation of the side brushes in the other side direction.

The plurality of side brushes may include a first side brush and side brushes. The first side brush may be fixed to the rotation shaft so as to rotate prior to the remaining side brushes of the plurality of side brushes. The side brushes may be rotatably coupled to the rotation shaft so as to operate according to rotation of the first side brush.

The variable member may include a first support part and a second support part. The first support part may be formed in a protruding manner and configured to rotate by making contact with the first side brush that rotates prior to the remaining side brushes. The second support part may extend from the first support part and formed in a protruding manner in an opposite direction to the first support part.

The variable member may include a third support part and a fourth support part. The third support part may make contact with the second support part so as to rotate according to a rotation direction of the variable member. The fourth support part may extend from the third support part while protruding at an end portion of the variable part in an opposite direction to the third support part.

As described above, the external esthetic quality of the robot cleaner may be improved while possibly enhancing the cleaning performance.

Additional aspects and/or advantages of one or more embodiments will be set forth in part in the description which follows and, in part, will be apparent from the description, or may be learned by practice of one or more embodiments of disclosure. One or more embodiments are inclusive of such additional aspects.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
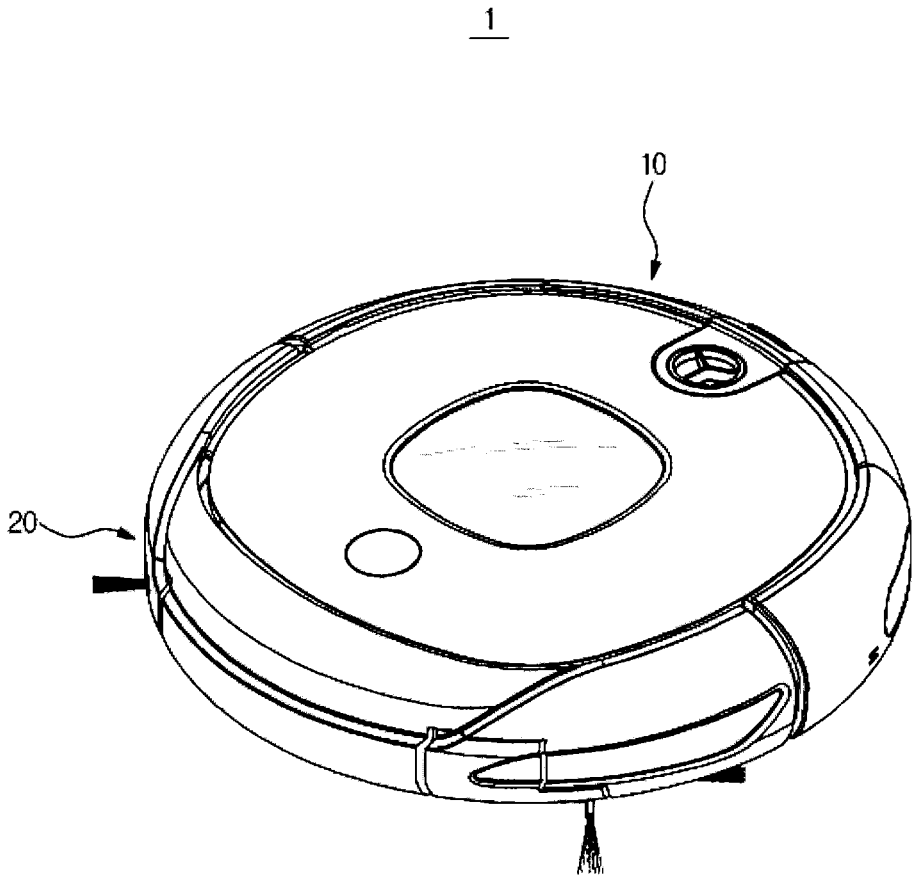
FIG. 1 is a view schematically illustrating a robot cleaner in accordance with one or more embodiments.

Reference will now be made in detail to one or more embodiments, illustrated in the accompanying drawings, wherein like reference numerals refer to like elements throughout. In this regard, embodiments of the present invention may be embodied in many different forms and should not be construed as being limited to embodiments set forth herein, as various changes, modifications, and equivalents of the systems, apparatuses and/or methods described herein will be understood to be included in the invention by those of ordinary skill in the art after embodiments discussed herein are understood. Accordingly, embodiments are merely described below, by referring to the figures, to explain aspects of the present invention.

Figure 2:
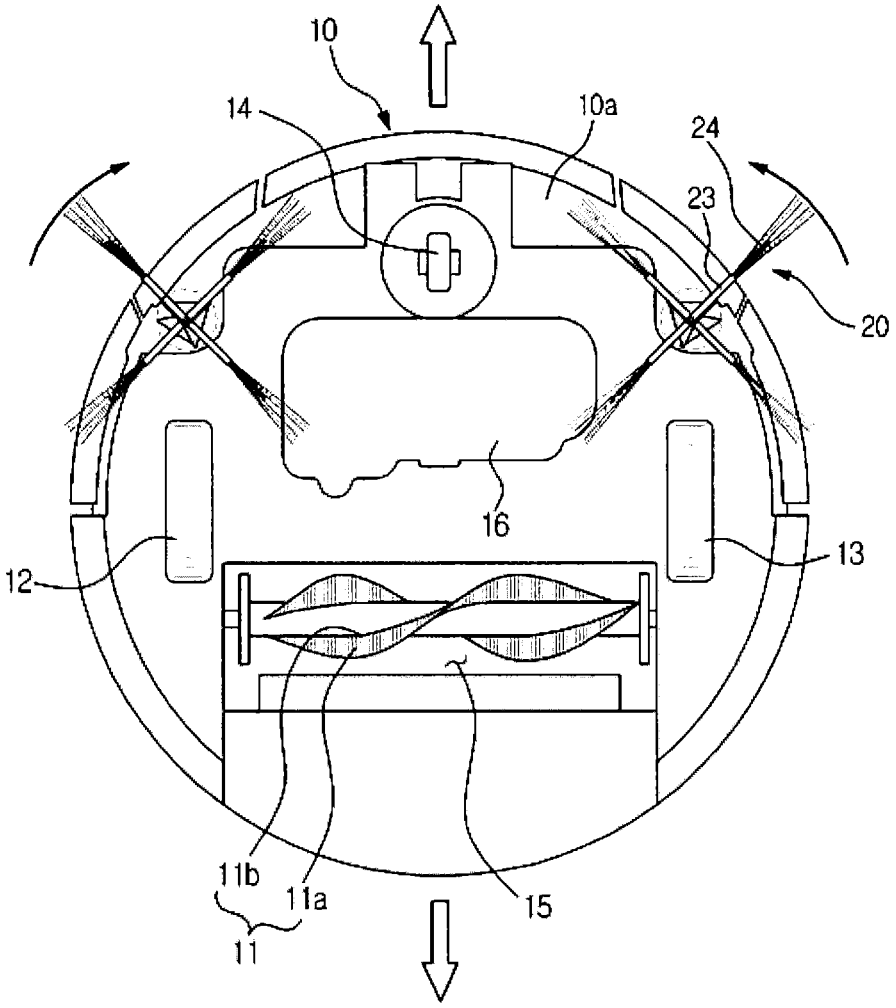
FIG. 2 is a bottom view schematically illustrating a side brush of a robot cleaner in accordance with one or more embodiments.

Referring to FIGS. 1 and 2, a robot cleaner 1 may include, for example, a body 10 forming the external appearance thereof, a main brush 11 configured to brush and guide dust on the floor toward a suction port 15 formed at a bottom surface 10*a* of the body 10, a power source 16 configured to supply a power for driving the body 10, driving wheels 12 and 13 and a caster 14 configured to move the body 10, and a side brush assembly 20 configured to clean areas adjacent to the floor, wall surfaces and corners of the floor.

The body 10, while forming the external appearance of the robot cleaner 1, may support various components installed at an inside of the robot cleaner 1.

The driving wheels 12 and 13 may be installed at the bottom surface 10*a* to enable the cleaning robot 1 to move back and forth and rotate in a process of performing a cleaning task. The driving wheels 12 and 13 may be disposed symmetrically to each other at a left side edge and a right side edge of the bottom surface 10*a*, respectively.

In addition, the caster 14 may be installed at a front side edge of the bottom surface 10*a* to enable a stable posture of the body 10. The driving wheels 12 and 13 and the caster 14 may be provided in a single assembly, and detachably mounted on the body 10.

The power source 16 may include a battery configured to supply a driving power while being electrically connected to various driving apparatuses that are configured to drive various components mounted at an inside the body 10.

The main brush 11 may be mounted at the suction port 15 of the bottom surface 10*a* of the body 10 so as to allow dust on the flow to be introduced to the suction port 15.

The suction port 15 may be positioned at a rear side away from the center of the bottom surface 10*a* of the body 10.

The main brush 11 may include a roller 11*b* and a main brush 11*a* installed at an outer surface of the roller 11*b*. The roller 11*b* rolls, and by stirring the dust on the floor, guides the dust toward the suction port 15.

Although not shown on the drawings, a blower apparatus to generate a suction force may be provided at an inside the suction pot 15 to move the introduced dust to a dust collecting apparatus.

In addition, the side brush assembly 20 may be mounted at the bottom surface 10*a* of the body 10 to gather dust toward the suction port 15.

The side brush assembly 20 may be installed in one pair at both sides of the body 10, and while rotating toward the center of the body 10 of the robot cleaner 1, may collect dust toward the main brush 11 provided at the center of the body 10.

Figure 3:
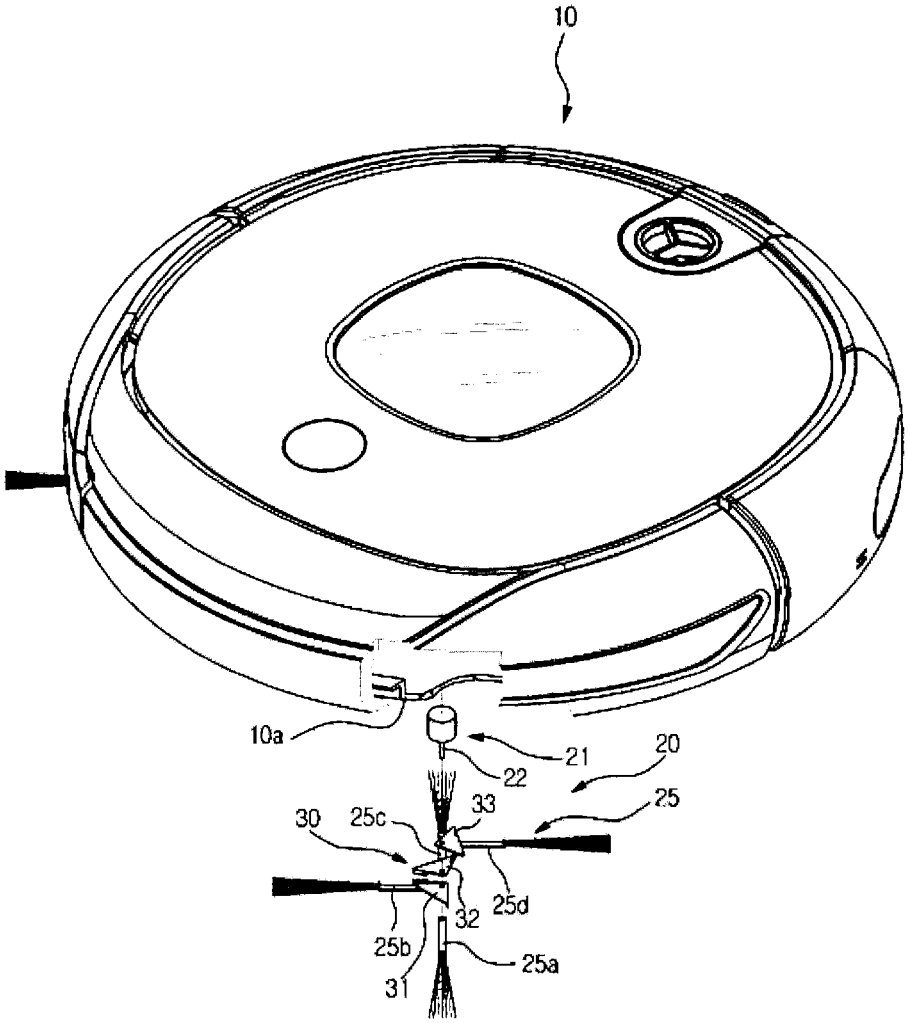
FIG. 3 is an exploded perspective view illustrating the robot cleaner having a side brush assembly mounted thereon in accordance with one or more embodiments.
Figure 4:
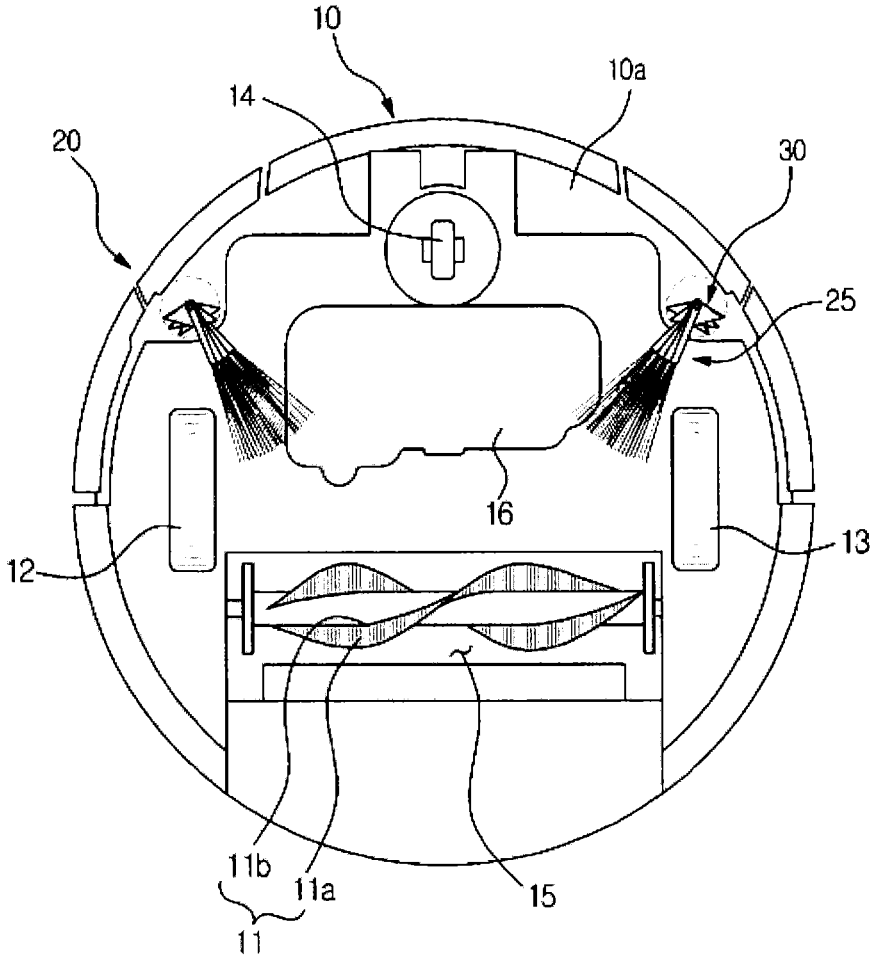
FIG. 4 is a bottom view illustrating a state of the side brush assembly being folded in accordance with one or more embodiments.

Referring to FIGS. 3 and 4, the side brush assembly 20 may include, for example, a motor 21 installed at the bottom surface 10*a* of the body to supply power, a rotation shaft 22 coupled 22 to the motor 21, a plurality of side brushes 25 coupled to the rotation shaft 22, and a variable member 30 provided between each of the side brushes 25.

The side brush 25 may include, for example, a side brush arm 23 and a brush 24 mounted at one end portion of the side brush arm 23 (See FIG. 2)

the side brush assembly 20 may be mounted in a way not to be exposed to the outside the body 10.

The plurality of side brushes 25 coupled to the rotation shaft 22 of the motor 21 may have intervals thereof changed with respect to one another so that the side brushes 25 may not be observed at the outside the body 10.

The side brushes 25 may include, for example, a first side brush 25*a* fixed to the rotation shaft 22 so as to rotate by receiving a rotating force of the motor 21, a second side brush 25*b* configured to rotate together with the first side brush 25*a*, a third side brush 25*c* configured to rotate together with the second side brush 25*b*, and a fourth side brush 25*d* configured to rotate together with the third side brush 25*c*. The side brushes 25*b*, 25*c*, and 25*d* may be rotatably coupled to the rotation shaft 22 so they do not receive any rotating force from the motor 21. Also, though the side brushes 25 are described as having four side brushes in this embodiment, the side brushes 25 may be provided with more or fewer than four side brushes.

A variable member 30 may be provided between each of the side brushes 25 to change the intervals between the side brushes 25.

The variable member 30 may include, for example, a first variable part 31 on which the first side brush 25*a* and the second side brush 25*b* may be mounted, a second variable part 32 on which the third side brush 25*c* may be mounted, and a third variable part 33 on which the fourth side brush 25*d* may be mounted. The variable member 30 also may have more or fewer than three variable parts according to the number of the side brushes 25 provided to the side brush assembly 20.

The second side brush 25*b*, the third side brush 25*c* and the fourth side brush 25*d* may be fixedly installed at the first variable part 31, the second variable part 32 and the third variable part 33, respectively.

Figure 5:
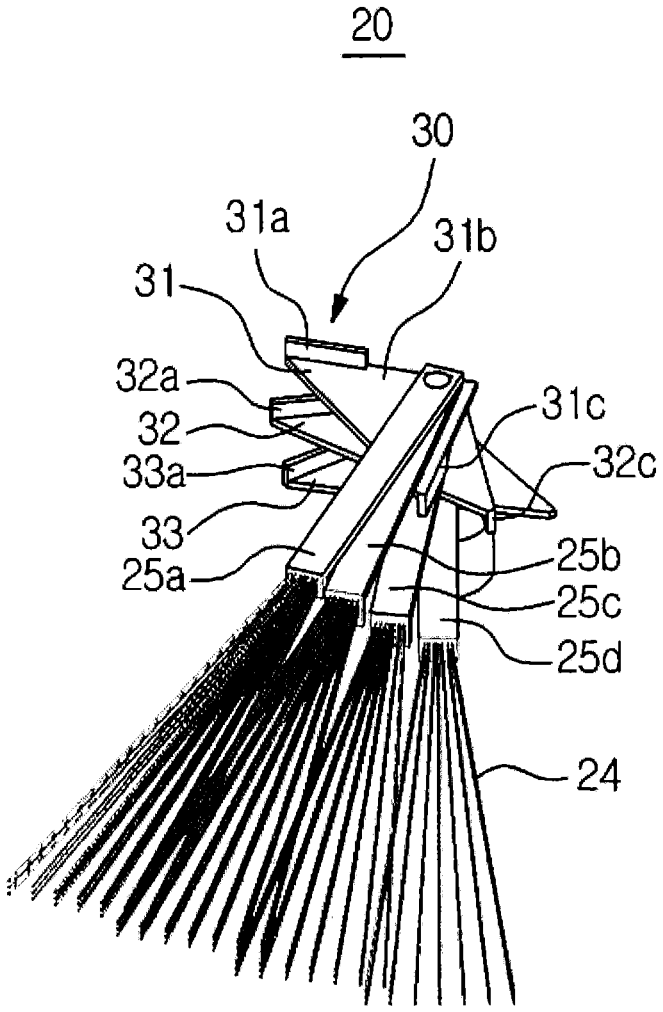
FIGS. 5 through 8 are views illustrating a state of unfolding the side brush assembly, which is folded, in accordance with one or more embodiments.
Figure 6:
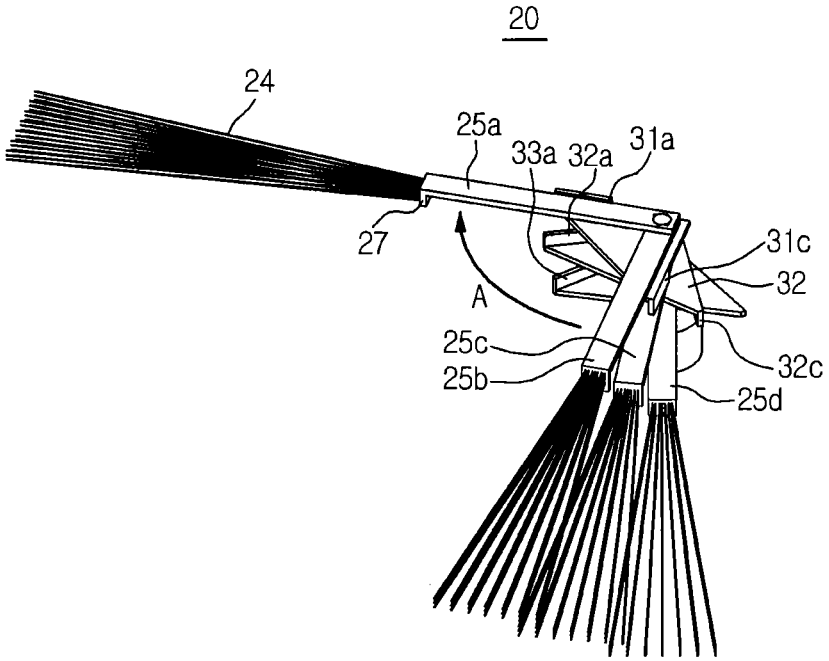

Referring to FIG. 5, the first variable part 31 may include, for example, a first support part 31*a* and a second support part 31*c* that may protrude in opposite directions to each other, and a first connection part 31*b* that may connect the first support part 31*a* to the second support part 31*c* to guide the rotation of the second side brush 25*b*.

The second variable part 32 may include, for example, a third support part 32*a* and a fourth support part 32*c* that may protrude in opposite directions to each other, and a second connection part 32*b* that may connect the third support part 32*a* to the fourth support part 32*c* to guide the rotation of the third side brush 25*c*. The third variable part 33 may include a fifth support part 33*a* and a sixth support part 33*c* (not shown) that may protrude in opposite directions to each other, and a third connection part 33*b* connecting the fifth support part 33*a* to the sixth support part 33*c* (not shown) to guide the rotation of the fourth side brush 25*d*. In this embodiment, though the third variable part 33 is described as having the same shape of the second variable part 32 for the convenience of manufacturing, the sixth support part 33*c* of the third variable part 33 (i.e., a last variable part which may guide the rotation of a last side brush) may be eliminated.

The first connection part 31*b*, the second connection part 32*b*, and the third connection part 33*b* may be configured to support such that the side brushes 25 perform a stable rotation.

The first support part 31*a* may protrude in an installation direction of the first side brush 25*a* and the second side brush 25*b*. The first support part 31*a* may make contact with the first side brush 25*a* when the first side brush 25*a* rotates by receiving the rotating force of the motor 21, and may support against the first side brush 25*a* so as to possibly rotate the first variable part 31.

The second support part 31*c* may extend from the first connection part 31*b* and may protrude at an end portion of the first variable part 31 in an opposite direction to the first support part 31*a*.

The second support part 31*c* protruding from the first variable part 31 as such may make contact with the third support part 32*a* of the second variable part 32, and may provide support so as to rotate the second variable part 32.

As the first variable part 31 rotates, the third support part 32*a* may make contact with the second support part 31*c*, and thus the second variable part 32 may rotate.

The side brushes 25 may rotate toward the center of the body 10 in an operation mode, to possibly gather dust on the floor toward the suction port 15 of the body 10. The variable member 30 may enable intervals of the side brushes 25 with respect to one another to be changed according to the direction of rotation of the side brushes 25.

If the side brushes 25 rotate in one side direction which is the same rotation direction in an operation mode of the side brushes 25, the intervals between the side brushes 25 may be increased, and if the side brushes 25 rotate in the other side direction, the intervals between the side brushes 25 may be decreased.

If the side brushes 25 are gathered to one side by having the intervals of the side brushes 25 decreased, the side brushes 25 may not be exposed to the outside of the body 10 of the robot cleaner 1, thereby possibly enhancing the external esthetic quality.

FIGS. 5 through 8 are views illustrating a state of unfolding a side brush assembly, which is folded, in accordance with one or more embodiments.

FIG. 5 illustrates a state of the side brushes 25 that are folded to be prevented from being exposed to the outside in a non-operation. To perform a cleaning task of the side brushes 25, the motor 21 may rotate and thus the first side brush 25*a* fixed to the rotation shaft 22 may rotate in a direction 'A' (see FIG. 6).

In this case, the direction at which the side brushes 25 rotate for the cleaning task is same as the direction 'A' at which the first side brush 25*a* rotates.

As the first side brush 25*a* rotates on the rotation shaft 22, the first side brush 25*a*, while making contact with the first support part 31*a* of the first variable part 31, may deliver a rotating force to the first support part 31*a*.

As an example, the first side brush 25*a* upon contact with the first support part 31*a* and the second side brush 25*b* that is fixed to the first variable part 31 may be spaced apart from each other by an angle of 90 degrees if four side brushes 25 are provided with the side brush assembly 20.

As the first variable part 31 rotates, the second side brush 25*b* fixed to the first variable part 31 may move together with the rotation of the first variable part 31.

As the first variable part 31 rotates, the second support part 31*c* of the first variable part 31 may make contact with the third support part 32*a* of the second variable part 32, and thus the second variable part 32 may rotate.

Figure 7:
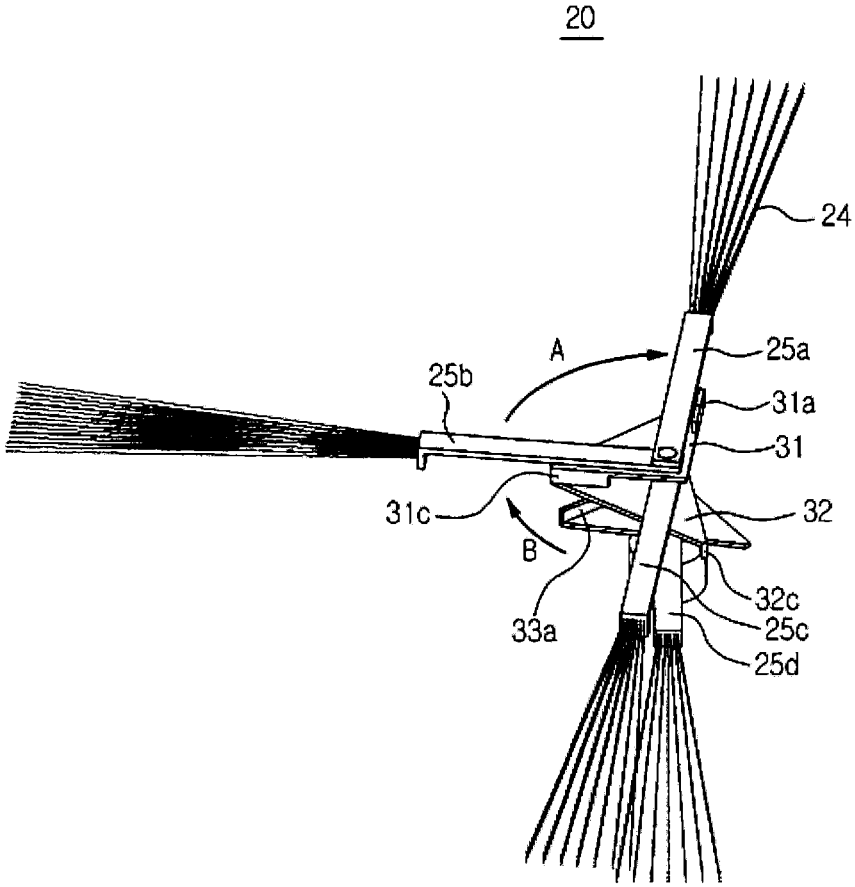

At this time, the third side brush 25*c* fixed to the second variable part 32 may rotate together with the rotation of the second variable part 32 in a direction 'B' (see FIG. 7).

Figure 8:
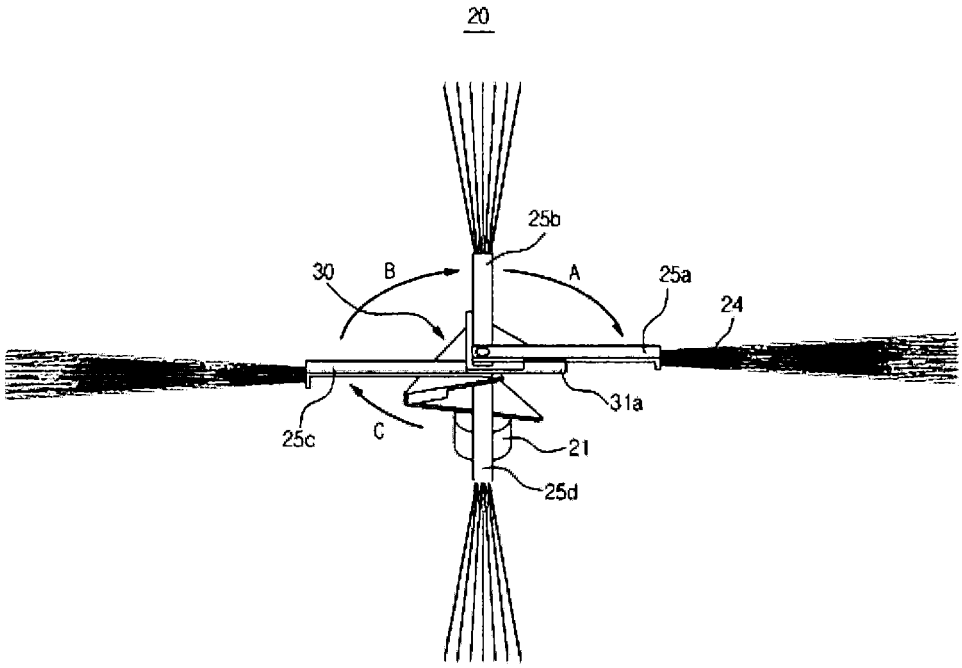

As the second variable part 32 rotates, the fourth support part 32*c* of the second variable part 32 may make contact with the fifth support part 33*a* of the third variable part 33 to which the fourth side brush 25*d* is fixed, and thus the third variable part 33 may rotate in a direction 'C' (see FIG. 8).

Accordingly, the intervals between the first side brush 25*a* through the fourth side brush 25*d* may be increased in the direction of rotation of the side brushes 25.

Figure 9:
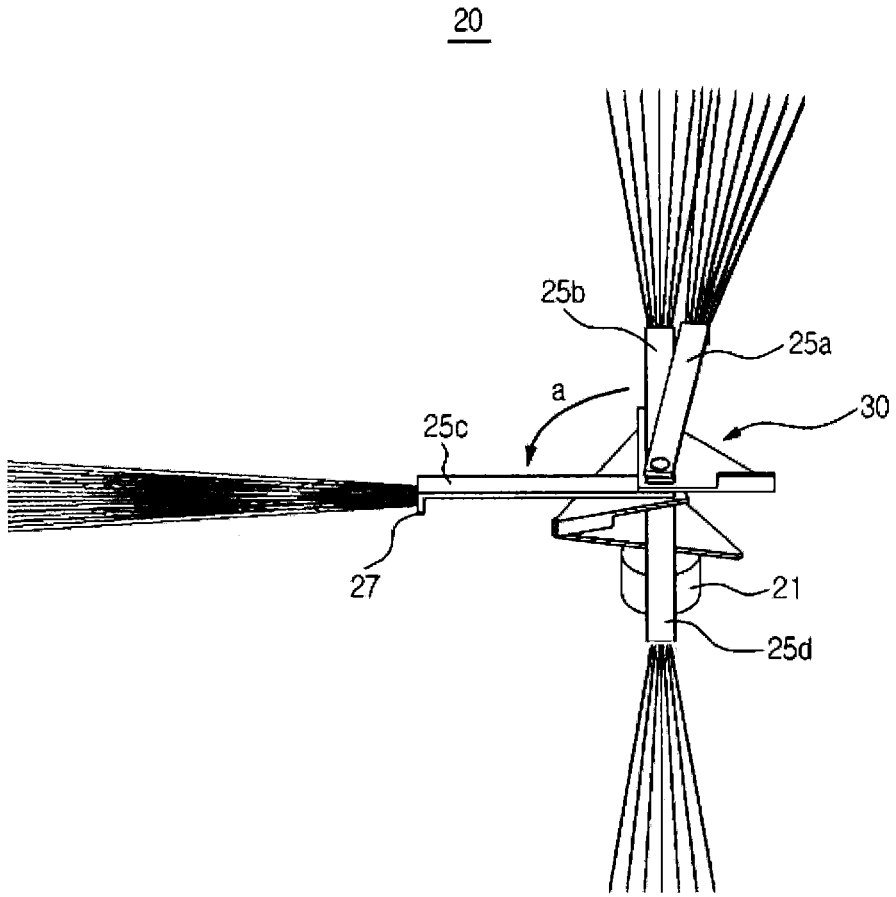
FIGS. 9 and 10 are views illustrating a state of folding the side brush assembly, which is unfolded, in accordance with one or more embodiments.
Figure 10:
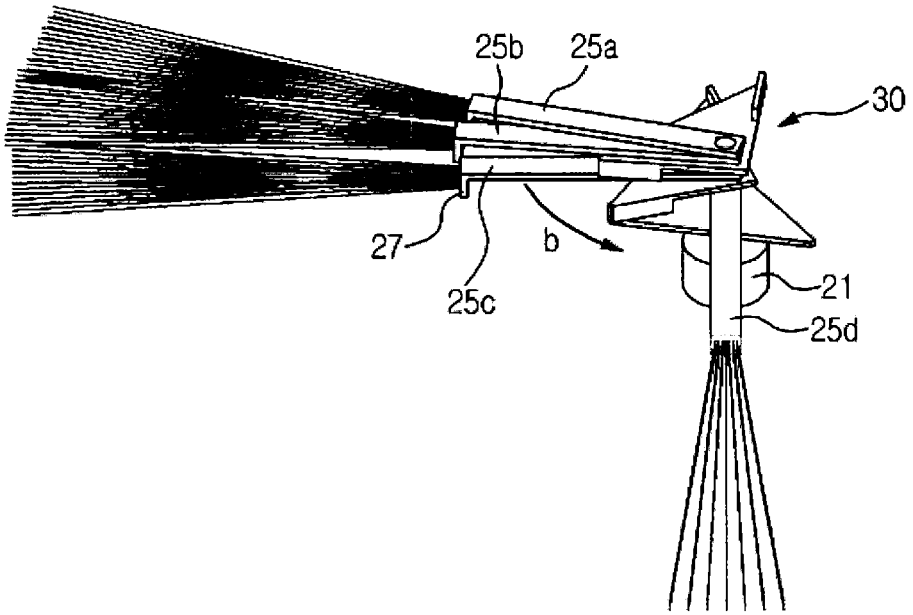

FIGS. 9 and 10 are views illustrating a state of folding a side brush assembly, which is unfolded, in accordance with one or more embodiments.

The side brushes 25 may be rotated in the opposite direction in a non-operation state, to possibly prevent the side brushes 25 from being exposed to the outside of the body 10.

The motor 21 may rotate in the opposition direction, that is, in a direction 'a' (see FIG. 9).

The first side brush 25*a*, while rotating in the opposition direction by the rotating force of the motor 21, may move toward the second side brush 25*b* that is spaced apart from the first side brush 25*a*.

A linking protrusion 27 may be formed at the side brush arm 23 of each of the plurality of side brushes 25 in a protruding manner.

Accordingly, the linking protrusion 27 of the first side brush 25*a* may make contact with the second side brush 25*b*, and thus may deliver a rotating force of the first side brush 25*a* to the second side brush 25*b*.

The second side brush 25*b*, which may rotate by the rotation of the first side brush 25*a*, may move toward the third side brush 25*c*, and the third side brush 25*c*, while making contact with the linking protrusion 27 of the second side brush 25*b*, may rotate toward the fourth side brush 25*d* in a direction 'b' (see FIG. 10) by the rotating force being delivered from the first side brush 25*a*.

The rotating force of the first side brush 25*a* may be delivered by the linking protrusion 27 each formed at the respective side brushes 25 as such, and the side brushes 25 may be gathered to one side by having the intervals between the side brushes 25 decreased. Accordingly, the side brushes 25 may be prevented from being exposed to the outside of the body 10 of the robot cleaner 1, thereby possibly improving the external esthetic quality. The motor 21 may be a step motor, for example, to locate the folded side brushes 25 not to be exposed to an outside of the body 10. Alternately, a stopper structure to allow a rotation of the side brushes 25 in a rotational direction of an operation mode and to prevent a rotation of the side brushes 25 in a rotational direction of a non-operation mode in order not to rotate over an outside of the body may be provided below the side brushes 25 on the bottom 10*a* of the body 10.

Figure 11:
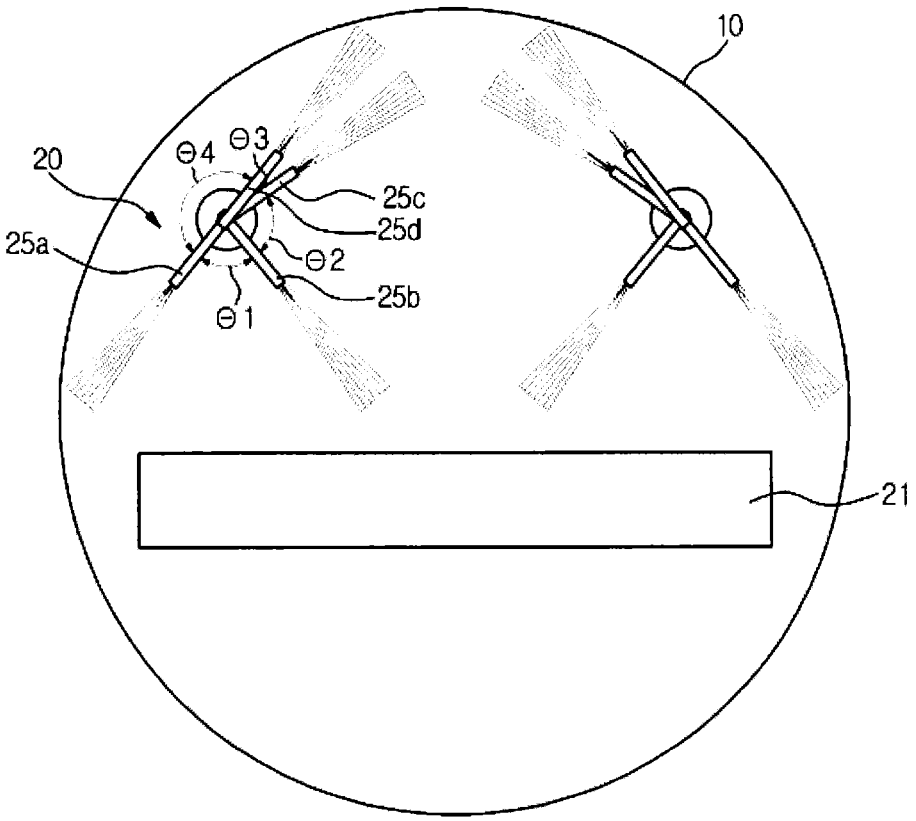
FIG. 11 is a view schematically illustrating side brushes having intervals thereof changed in accordance with one or more embodiments.

Referring to FIG. 11, the plurality of side brushes 25 may be prevented from being exposed to the outside of the body 10 of the robot cleaner 1 by having the angular intervals (θ) thereof changed.

An interval (θ1) between the first side brush 25*a* and the second side brush 25*b*, an interval (θ2) between the second side brush 25*b* and the third side brush 25*c*, an interval (θ3) between the third side brush 25*c* and the fourth side brush 25*d*, and an interval (θ4) between the fourth side brush 25*d* and the first side brush 25*a* may be different from one another.

In one or more embodiments, the interval (θ4) between the fourth side brush 25*d* and the first side brush 25*a* may be changed to prevent the side brushes 25 from being observed from the outside of the body 10 of the robot cleaner 1 within certain angles as shown in FIG. 11. Also, a step motor or a one-way stopper structure may be provided to locate the side brushes which have different intervals not to be exposed to the outside of the body 10.

According to the structure as such, the intervals between the side brushes 25 may be changed, so that the robot cleaner 1 may have an improved esthetic quality.

In one or more embodiments, any apparatus, system, element, or interpretable unit descriptions herein include one or more hardware devices or hardware processing elements. For example, in one or more embodiments, any described apparatus, system, element, retriever, pre or post-processing elements, tracker, detector, encoder, decoder, etc., may further include one or more memories and/or processing elements, and any hardware input/output transmission devices, or represent operating portions/aspects of one or more respective processing elements or devices. Further, the term apparatus should be considered synonymous with elements of a physical system, not limited to a single device or enclosure or all described elements embodied in single respective enclosures in all embodiments, but rather, depending on embodiment, is open to being embodied together or separately in differing enclosures and/or locations through differing hardware elements.

While aspects of the present invention has been particularly shown and described with reference to differing embodiments thereof, it should be understood that these embodiments should be considered in a descriptive sense only and not for purposes of limitation. Descriptions of features or aspects within each embodiment should typically be considered as available for other similar features or aspects in the remaining embodiments. Suitable results may equally be achieved if the described techniques are performed in a different order and/or if components in a described system, architecture, device, or circuit are combined in a different manner and/or replaced or supplemented by other components or their equivalents.

Thus, although a few embodiments have been shown and described, with additional embodiments being equally available, it would be appreciated by those skilled in the art that changes may be made in these embodiments without departing from the principles and spirit of the invention, the scope of which is defined in the claims and their equivalents.

What is claimed is:

1. A robot cleaner comprising:

a body to form an external appearance of the robot cleaner; and a side brush assembly installed at the body, wherein the side brush assembly comprises:

a motor installed at the body;

a rotation shaft coupled to the motor;

a plurality of side brushes coupled to the rotation shaft, the plurality of side brushes including a first side brush fixed to the rotation shaft so as to be rotated and at least one second side brush rotatably coupled with respect to the rotation shaft so as to operate according to rotation of the first side brush; and a variable member installed between the plurality of side brushes and configured to allow intervals of the first side brush and the at least one second side brush to be changed, wherein the plurality of side brushes interoperate with each other by the variable member such that respective intervals between the plurality of side brushes are increased or decreased according to a rotation direction of the plurality of side brushes.

2. The robot cleaner of claim 1, wherein the respective intervals between the plurality of side brushes are increased according to a rotation of the plurality of side brushes in a rotational direction of an operation mode.

3. The robot cleaner of claim 1, wherein the respective intervals between the plurality of side brushes are decreased according to a rotation of the plurality of side brushes in a rotational direction of a non-operation mode, such that when rotation of the plurality of side brushes is stopped the respective intervals between the plurality of side brushes are decreased and the plurality of side brushes are not exposed outside the body.

4. The robot cleaner of claim 1, wherein the variable member comprises:

a variable part provided to link the first side brush with the at least one second side brush.

5. The robot cleaner of claim 4, wherein the variable part comprises:

a first support part protruding at an end portion of the variable part and contacting the first side brush when the first side brush rotates in an operation mode;

a second support part protruding at another end portion of the variable part in an opposite direction to the first support part; and a connection part connecting the first support part to the second support part and guiding a rotation of the at least one second side brush.

6. The robot cleaner of claim 4, wherein the variable member comprises:

a first variable part having a first support part to protrude at an end portion of the first variable part and to contact the first side brush when the first side brush rotates in an operation mode and a second support part to protrude at another end portion of the first variable part in an opposite direction to the first support part, and a second variable part having a third support part to protrude at an end portion of the second variable part and to contact the second support part of the first variable part when the first variable part rotates by the rotation of the first side brush.

7. The robot cleaner of claim 1, wherein each side brush of the plurality of side brushes comprises:

a side brush arm coupled to the rotation shaft; and a brush provided at the side brush arm.

8. The robot cleaner of claim 7, wherein each side brush of the plurality of side brushes further comprises:

a linking protrusion configured to allow the plurality of side brushes to be linked to one another according to the rotation of the plurality of side brushes in the rotational direction of the non-operation mode.

9. The robot cleaner of claim 8, wherein each linking protrusion of the plurality of side brushes is formed on a side brush arm of each side brush of the plurality of side brushes.

10. The robot cleaner of claim 1, wherein the motor is a step motor to locate the plurality of side brushes with changeable intervals.

11. A robot cleaner comprising:

a body to form an external appearance of the robot cleaner; and a side brush assembly installed at the body, wherein the side brush assembly comprises:

a motor installed at the body;

a rotation shaft coupled to the motor;

a plurality of side brushes coupled to the rotation shaft, a plurality of side brushes coupled to the rotation shaft, the plurality of side brushes including a first side brush fixed to the rotation shaft so as to be rotated and at least one second side brush rotatably coupled with respect to the rotation shaft so as to operate according to rotation of the first side brush; and a variable member installed between the plurality of side brushes and configured to allow intervals of the first side brush and the at least one second side brush to be changed, wherein the plurality of side brushes interoperate with each other by rotation of the first side brush fixed to the rotation shaft so as to be rotated according to rotation of the motor and by rotation of the variable member.

12. The robot cleaner of claim 11, wherein the respective intervals between the plurality of side brushes are increased according to a rotation of the plurality of side brushes in a rotational direction of an operation mode, and the respective intervals between the plurality of side brushes are decreased according to a rotation of the plurality of side brushes in a rotational direction of a non-operation mode, such that the plurality of side brushes are not exposed to an outside of the body when rotation of the plurality of side brushes is stopped.

13. The robot cleaner of claim 11, wherein each side brush of the plurality of side brushes further comprises:

a linking protrusion configured to allow the side brushes to be linked to one another according to a rotation of the side brushes in a rotational direction of a non-operation mode.

14. The robot cleaner of claim 11, wherein the plurality of side brushes comprises:

a first side brush fixed to the rotation shaft so as to rotate according to a rotation of the motor; and at least one second side brush rotatably coupled to the rotation shaft so as to operate according to a rotation of the first side brush and the variable member.

15. The robot cleaner of claim 14, wherein the variable member comprises:

a connection part fixedly supporting the at least one second side brush and guiding a rotation of the at least one second side brush a support part extending from the connection part in a protruding manner and configured to rotate by making contact with the first side brush that rotates.

16. The robot cleaner of claim 11, wherein the motor is a step motor to locate the plurality of side brushes with changed intervals.

* * * * *